US009679549B2

(12) United States Patent
Nelson

(10) Patent No.: US 9,679,549 B2
(45) Date of Patent: Jun. 13, 2017

(54) PRECISION SOLID STATE POSITION TRANSDUCER USING MAGNETIC FIELDS, METHOD FOR DETECTING THE POSITION OF A SPOT ON AN ELONGATE MEMBER, AND MUSICAL INSTRUMENT

(71) Applicant: Gary Alan Nelson, Port Townsend, WA (US)

(72) Inventor: Gary Alan Nelson, Port Townsend, WA (US)

( * ) Notice: Subject to any disclaimer, the term of this patent is extended or adjusted under 35 U.S.C. 154(b) by 0 days.

(21) Appl. No.: 15/187,101

(22) Filed: Jun. 20, 2016

(65) Prior Publication Data

US 2016/0372098 A1 Dec. 22, 2016

Related U.S. Application Data

(60) Provisional application No. 62/182,075, filed on Jun. 19, 2015.

(51) Int. Cl.
*G10H 3/18* (2006.01)
*G10H 3/14* (2006.01)

(52) U.S. Cl.
CPC ..... *G10H 3/181* (2013.01); *G10H 3/143* (2013.01); *G10H 2220/161* (2013.01); *G10H 2220/521* (2013.01)

(58) Field of Classification Search
USPC ..... 84/726
See application file for complete search history.

(56) References Cited

U.S. PATENT DOCUMENTS 5,585,588 A * 12/1996 Tumura ..... G10H 3/26 84/726
6,271,456 B1 8/2001 Nelson
7,259,318 B2 * 8/2007 Chiliachki ..... G10H 3/181 84/290
8,969,701 B1 * 3/2015 Dixon ..... G10H 3/143 84/723
2014/0318350 A1 * 10/2014 Krasnov ..... G10H 3/143 84/726

OTHER PUBLICATIONS

Walter G. Jung, "Op Amp Applications Handbook", Analog Devices Inc., 2005, ISBN: 978-0-7506-7844-5.

* cited by examiner

*Primary Examiner* — Christopher Uhlir
(74) *Attorney, Agent, or Firm* — Wenderoth, Lind & Ponack, L.L.P.

(57) ABSTRACT

The position of an elongate member, such as a string of a musical instrument, e.g. a stand-up bass, is detected by creating a radial magnetic field at a spot along the elongate member in which the magnetic field approximates a disk shape with radial field lines that decay as 1/R. R is the distance from the center of the elongate member along a radial field line perpendicular to the axis of the elongate member. Then the position of the spot is detected using magnetic field sensors that are positioned proximal to and on opposite sides of the spot along the elongate member. Electrically amplifying the outputs of the sensors and detecting magnitude and direction of the motion of the spot from the physical orientation of the sensors do this.

24 Claims, 28 Drawing Sheets

| | Mono Single-Axis | Stereo Dual-Axis |
|---|---|---|
| Single Ended | 1 | 2 |
| Differential | 2 | 4 |

Fig. 18

PRECISION SOLID STATE POSITION TRANSDUCER USING MAGNETIC FIELDS, METHOD FOR DETECTING THE POSITION OF A SPOT ON AN ELONGATE MEMBER, AND MUSICAL INSTRUMENT

BACKGROUND OF THE INVENTION (1) Field of the Invention

This invention is a solid-state position transducer that can measure the 2-D (x-y) position of a rod moving in a measurement plane perpendicular to the z-axis direction of the rod. The rod has no measureable motion in the z-axis direction. The rod may be the ferromagnetic string of a musical instrument.

(2) State of the Prior Art

U.S. Pat. No. 6,271,456, by the same inventor as the present invention, and which is herein incorporated by reference in its entirety, is directed to a transducer and a musical instrument employing such a transducer. As recognized in that patent, the prior art uses pickups such as elongated electric coil type pickups, which have various problems in reproducing sound that is a true representation of the acoustic properties of the instrument. Other types of known pickups include piezoelectric, strain gauge and accelerometer type electromechanical vibration sensors, but these are also not completely effective in faithfully converting the vibrations of the instrument strings into electrical signals that capture the true sound of the musical instrument. Other solutions recognized in the patent also have various problems. The patent thus proposes using a plurality of magneto resistive elements connected in Wheatstone bridge configurations.

The patent employs a magnetic field that interacts with the with the magneto resistive elements. The magnetic field may be created by a permanent magnet mounted behind the pickup or be generated by a current carried by the string itself. The pickup is positioned so that the vibration of the string causes perturbations in the magnetic field, which in turn alters the resistance of the magneto resistive elements. The electrical pickup of the patent thus senses the position of the vibrating string by measuring changes in the magnetic field applied to opposite sides of a giant magneto resistance (GMR) sensor.

The patent also states that the source of the magnetic field is immaterial, and notes that a permanent biasing magnet could be replaced with a magnetic field carried by the string itself, so that the entire magnetic field would move relative to a sensor. The patent further notes that one way to create this magnetic field is to magnetize the string itself by moving a relative large permanent toward the electrically conductive string, touching the string with the magnet and then slowly moving the magnet away from the string. No technical details of this effect were understood at that time.

SUMMARY OF THE INVENTION

In U.S. Pat. No. 6,271,456, while there was recognition that a magnetic field could be induced on the string of a musical instrument so that a GMR sensor could detect movement of the field, the patent does not recognize or discuss the nature of the induced magnetic field. Specifically, there is no indication of where on the string the field should be induced, particularly with respect to the location of the poles of the induced magnetic field. The present inventor has now recognized that by inducing a radial magnetic field at a spot along an elongate member, such as a ferromagnetic string of a musical instrument, in which the magnetic field approximates a disk shape with radial field lines that decay as 1/R, where R is the distance from the center of the elongate member along a radial field line perpendicular to the axis of the elongate member, and with the spot having one polarity, and the elongate member having poles of the other polarity spaced along the elongate member on opposite sides of the first pole of the radial magnetic field located at the spot, the motion of the spot can be detected with great precision using magnetic field sensors positioned proximal to the spot along the elongate member by electrically amplifying the outputs of the sensors and thereby detecting the motion of the spot from the physical orientation of the sensors.

The present invention includes a solid-state position transducer that can measure the 2-D (x-y) position of a rod or elongate member moving in a measurement plane perpendicular to the z-axis direction of the rod. The rod has no measureable motion in the z-axis direction. See FIG. 1 as a reference. The cylindrical rod of the figure may be a ferromagnetic string of a musical instrument, but the concept is applicable to other elongate members of ferromagnetic material, such as any cylindrical rod that can move in the x-y plane and that has substantially no motion in the Z-axis direction. However, a principal application of this invention is to measure the instantaneous position of musical instrument strings. Most other string motion transducers or "pickups" measure string velocity. Because velocity is the derivative of position, the frequency response of these position sensors is flat from DC to beyond audibility, whereas velocity pickup response is proportional to frequency zero output at zero frequency. One result is that the amplitude response of the transducers of this invention is a factor of two greater per octave. For acoustic bass instruments, this contributes to the naturalness of the transduced sound.

The motion of a magnetic spot with an associated disk of magnetic field on an elongate member can be transduced using four configurations of magnetic field sensor devices depicted as a 2×2 matrix. See FIG. 18. A single-output (mono) transducer can measure motion along a single axis and produce one electrical signal. A stereo transducer measures position and motion along two orthogonal axes and produces two electrical signals—one for each component of motion. A stereo transducer can be viewed as two single axis transducers physically mounted at right angle to one another.

Each transducer can be configured using one or two sensor devices. Single sensor implementations measure the distance R from the center of the elongate member to the center of the measuring sensor and produce an electrical signal proportional to 1/R. Differential implementation places a pair of sensors on opposite sides of the magnetic spot and produces an electrical signal proportional to the difference between the two sensor outputs.

In practice the approach is limited to making position measurements inside circle several times larger in diameter than the rod or elongate member being measured. The specific method used in this invention employs a novel "disk of magnetic field" that radiates out from the point where the rod under measurement intersects the measurement plane. FIG. 2 shows the measurement plane with string in the center and the magnetic flux lines radiating outward. Assuming that such a disk of magnetic field can be produced, the measurement method uses 1, 2, or 4 solid-state magnetic field sensors, each with axis of sensitivity on a radial in the measurement plane. There are four feasible configurations using 1, 2 or 4 sensors as shown in FIG. 18.

There are two ways to produce a disk of magnetic field:

1. In principle, place the like poles of two cylindrical bar magnets in contact and note that there exists a disk of magnetic field around the point of contact—north-pole-to-north-pole or south-to-south. In practice, it is nearly impossible to force two like poles together in a stable configuration. One practical way to make a disk of magnetic field is to place two cylindrical bar magnets inside a snuggly fitting non-magnetic tube such that two like poles are pressed together as the magnets are glued into position. Where the two magnets come to (close) contact, the field in the plane perpendicular to the point of contact will be radial, and will thus decay as 1/R (R measured from the center of the magnetic cylinder).

2. Spot magnetize a ferromagnetic rod, such as the ferromagnetic string of a bass or cello. This process creates a novel effect as if a pair of cylindrical bar magnets were embedded in the magnetized string or rod. The preferred way to accomplish this is to use a novel tool comprised of three magnets configured as shown in FIG. 6 using permanent magnets and FIG. 7 using electromagnets.

In FIG. 6, Items 2, 3, and 4 are identical bar magnets magnetized along the longer axis and affixed to a pole piece (item 1). The magnets are spaced so as to optimize or maximize the diameter of the magnetic disk where the field approximates a disk. The magnetic field created in the string or rod looks like that shown in FIG. 5. The "magnetic disk" is a first order approximation of the actual field, but measured data show that the approximation is accurate in the range of operation required for the purposes of this invention. FIG. 9 shows measured data around a 2 mm bass guitar string compared with the 1/R prediction suggested by the first order magnetic disk approximation.

A third method to produce a disk of magnetic field is to apply the conceptual method of (2) above to manufacture a permanent magnet with like poles on opposite ends and a disk of magnetic field in the middle. Magnets of this type could be used as a magnetic field source for position measurements in applications not related to musical instruments.

BRIEF DESCRIPTION OF THE DRAWINGS

FIG. 18 is a table of sensor characteristics;

DETAILED DESCRIPTION OF PREFERRED EMBODIMENTS OF THE INVENTION

Figure 1:
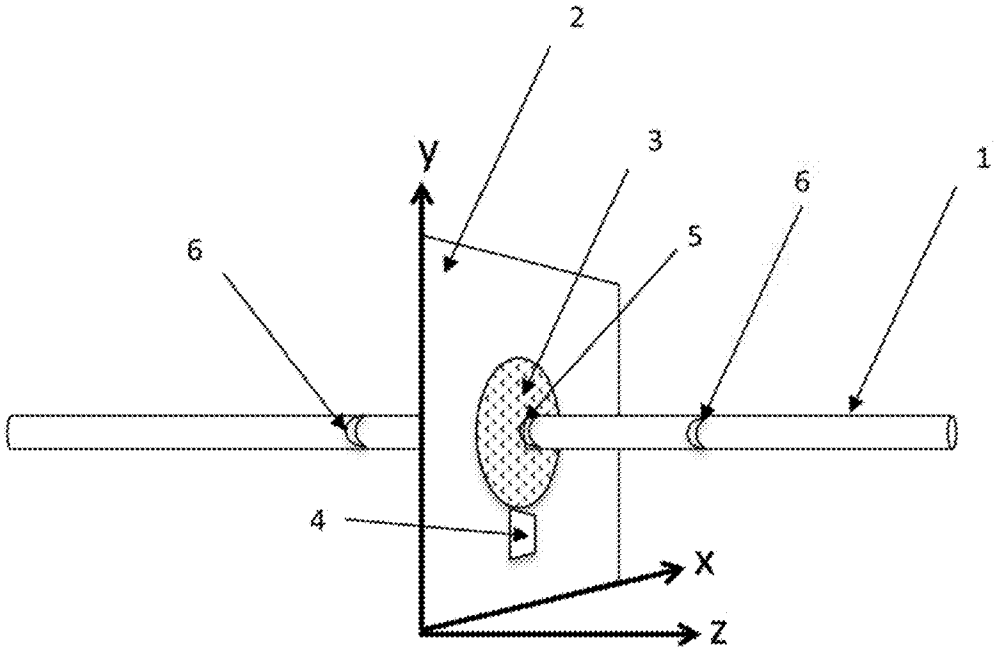
FIG. 1 is a schematic view of a cylindrical rod having a radial x-y plane and extending in a z direction.
Figure 2:
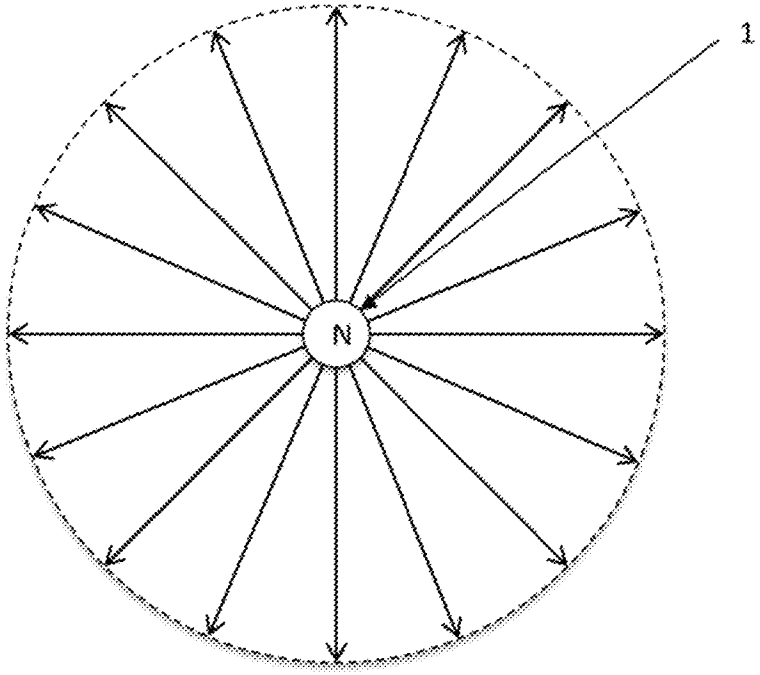
FIG. 2 is an illustration of the cylindrical rod of FIG. 1 taken along the z axis and showing the concept of the radial magnetic field.

FIG. 1 is a schematic view of a cylindrical rod having a radial x-y plane and extending in a z direction. A cylindrical rod 1, which may be an instrument string, e.g., has a measurement plane 2 that includes an area of motion or locus of movement 3 of the cylindrical rod 1. Sensors 4 are placed around the circumference of the area 3. Reference number 5 represents a magnetic spot source of a disk of magnetic field of one polarity and reference numbers 6 are opposite polarity poles. FIG. 2 shows the cylindrical rod 1 along the z-axis and the concept of the radial magnetic field. The magnetic spot source of a disk of magnetic field is created by spot magnetization, described below.

Spot Magnetization

A first central concept employed in this invention is Spot Magnetization of the ferromagnetic rods or musical instrument strings. This is accomplished in one of two ways:

1. By bringing one pole of a long thin bar magnet into contact with the string and then removing it slowly. Alternatively, an electromagnet can be used where a pulse of electrical current passes through a solenoid coil wrapped having a small diameter core.
2. By using a novel tool to control the geometry of the magnetic disk and the associated magnetic field that creates the effect. As in 1, this tool can be implemented either with permanent magnets or electro-magnets.

In the first method, if the north pole of the magnetizing magnet is brought into contact with the string at a specific point, that point will become a South Pole with a magnetic field emanating from the spot in a disk with the field diminishing as 1/R, where R is the distance from the center of the string. This method spontaneously creates two opposite polarity spots a short distance above and below the contact spot. This method provides no control over the locations of the spontaneously produced opposite polarity spots. Said another way, the lengths of the virtual magnets are uncontrolled. A better approach is described below.

Figure 3:
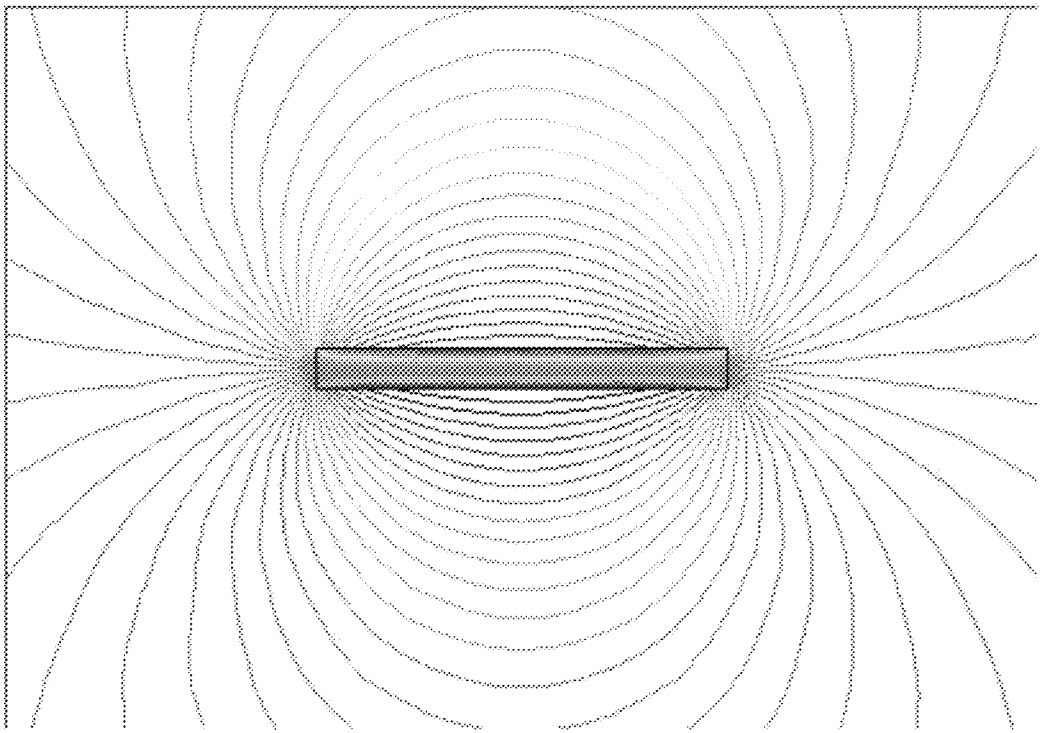
FIG. 3 is a schematic illustration of a single cylindrical bar magnet.
Figure 4:
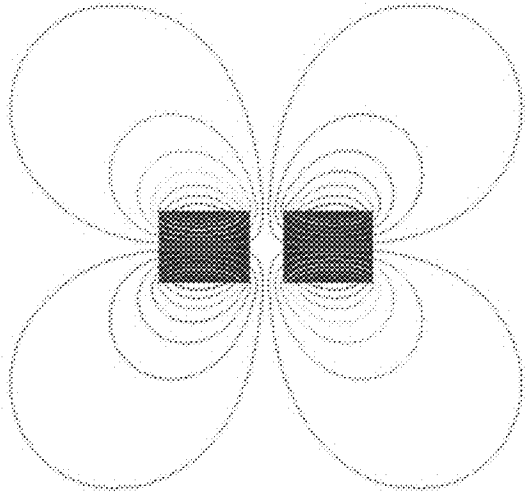
FIG. 4 is a schematic illustration of two cylindrical bar magnets establishing an approximately radial field.
Figure 5:
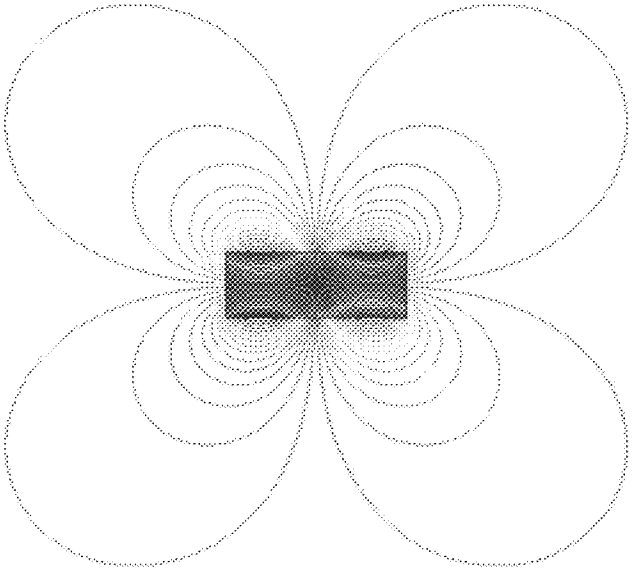
FIG. 5 is a schematic illustration of two cylindrical bar magnets with like poles in contact.

Generic pictures of bar magnets will help teach the concept. FIG. 3 shows the magnetic field around a long thin bar magnet. The field at each end is locally axial with no radial field. FIG. 4 shows two cylindrical bar magnets with like poles coming into close proximity. The field at the center is then approaching radial as a first order approximation. FIG. 5 shows the two bar magnets with like poles in contact. Now the field at the point of contact is disk-like and locally radial, and thus there is formed a magnetic field that approximates a disk shape with radial field lines that decay as 1/R, where R is the distance from the center of the elongate member along a radial field line perpendicular to the axis of the elongate member. These diagrams are generic and represent the spot magnetization concept. In order to understand this process, the inventor modeled the spot magnetization process using a magnetic field simulation program. The only way to create the observed effect was to place the like poles of two permanent bar magnets into contact. The results of that simulation are shown in FIG. 3 (showing the output of a simulation of a single cylindrical bar magnet), FIG. 4 (showing the output of a simulation of two cylindrical bar magnets establishing an approximately radial field), and FIG. 5 (showing the output of a simulation of a two cylindrical bar magnets with like poles in contact).

Figure 9:
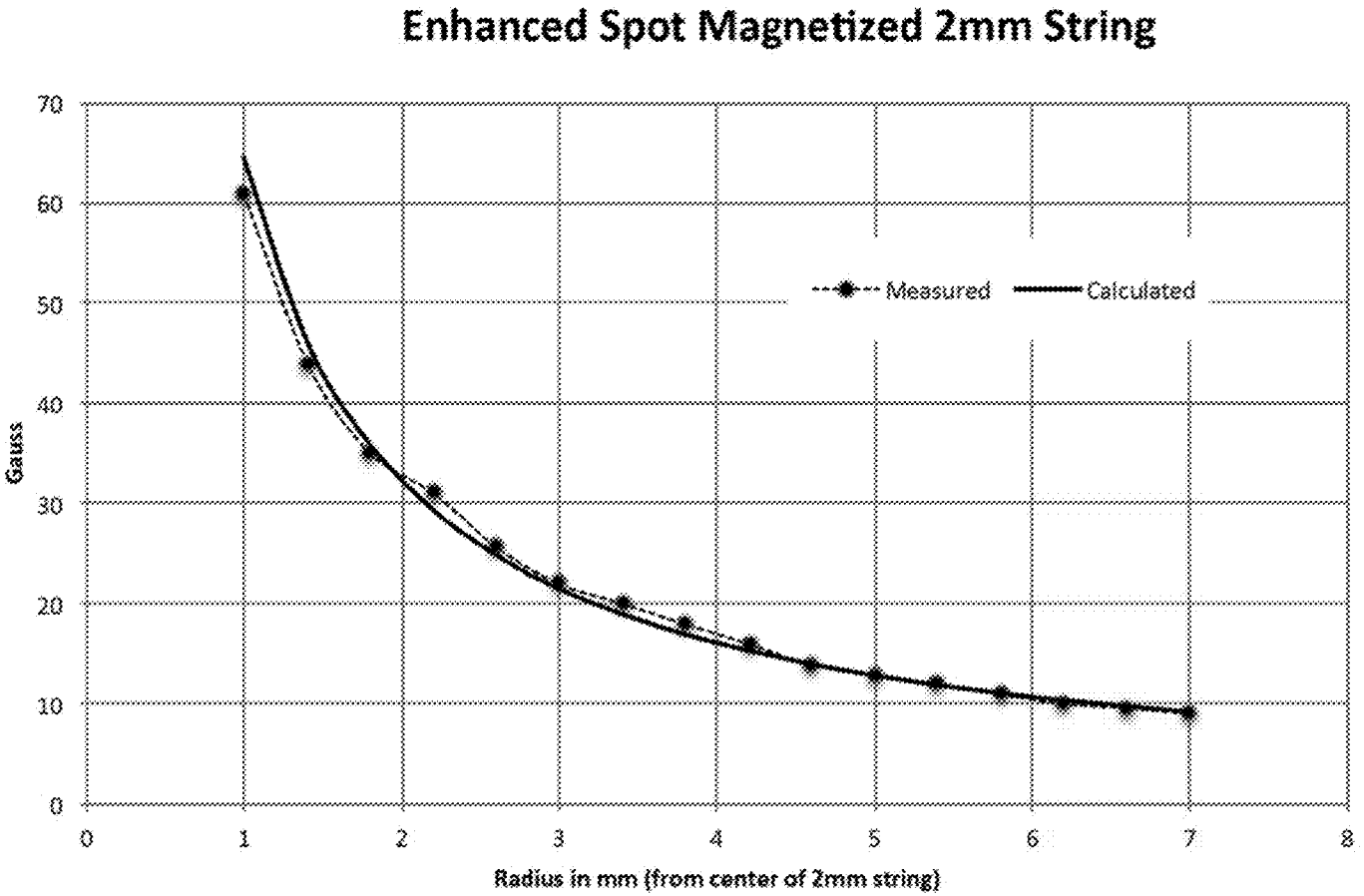
FIG. 9 is a graph comparing measured and predicted 1/R magnetic field around a 2 mm instrument string.

A consequence of a spot magnetization that generates a south pole, e.g., is that North Pole spots spontaneously occur along the rod or string above and below the desired South Pole spot. See e.g. poles 6 on either side of pole 5 in FIG. 1. The effect is accurately modeled as a pair of cylindrical bar magnets with like pole forced into contact. When this is done with magnetic field simulation software, the field around the point of contact acts as a disk of radiating radial magnetic field lines that diminish as 1/R. This has been validated by experimental results measuring the radial field at the spot at several distances from the surface of the string. Cross-plots of such measured data follow a 1/R curve. This is shown in FIG. 9.

Hence, spot magnetization is a novel effect that is central to the operation of the transducers in this invention.

Figure 6:
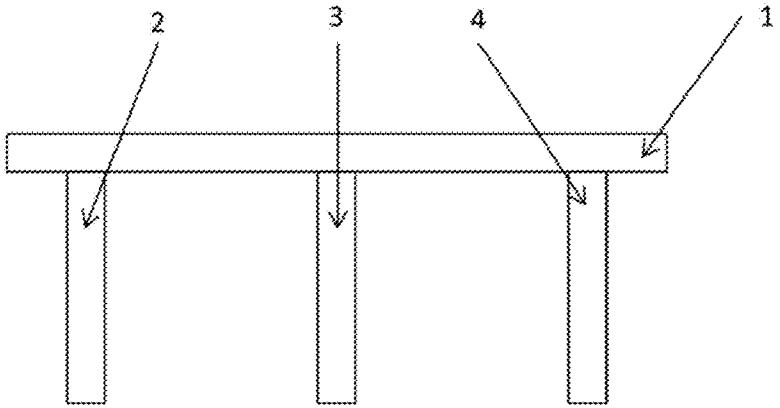
FIG. 6 shows a spot magnetization tool comprised of three equally spaced permanent magnets.
Figure 7:
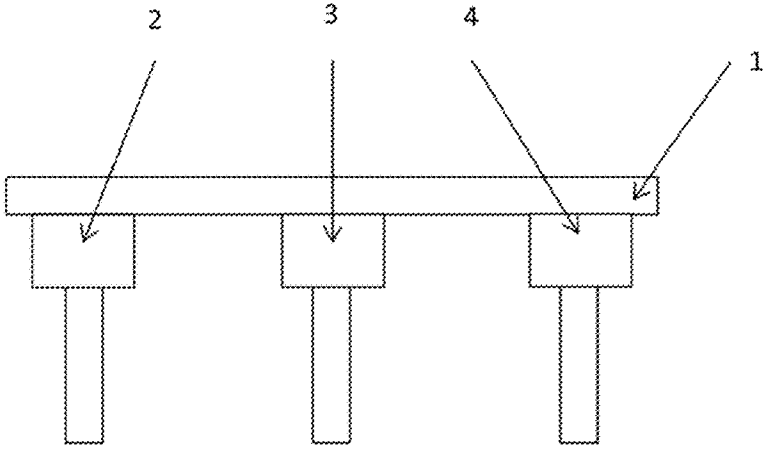
FIG. 7 is a spot magnetization tool comprised of three equally spaced electro magnets.

An improved method of spot magnetization employs a novel tool comprised of three identical bar magnets (or electromagnets) as shown in FIG. 6 and FIG. 7. FIG. 6 depicts three permanent magnets.

This tool can be comprised of permanent bar magnets or electromagnets 2, 3 & 4 connected to ferromagnetic pole piece 1. These are identical bar magnets with N-5 field aligned on the long axis. Center magnet (3) has an N pole down (or S pole down) while magnets 2 & 4 having N poles up (or S poles up). In other words, the center magnet polarity is opposite the two outer magnets. To create a magnetic spot on the string of a musical instrument, the center magnet 3 is brought into contact with the string at the desired spot. The outer magnets 2 and 4 also contact the string above and below the desired spot. The desired spot is typically close to (about 2 cm from) the bridge in which case the magnets are spaced such that the lower one intersects the string at the bridge. After contact is made, the magnets saturate the ferromagnetic string following a magnetization curve similar to FIG. 8. The tool is then withdrawn slowly so that the string retains a remanence magnetic field of FIG. 8.

A further improvement of the process employs a tool comprised of electromagnets that, upon being energized, create the equivalent opposite fields as described above. A pulse of current is sufficient to achieve magnetization, after which the deactivated tool can be removed without concern for demagnetizing adjacent strings.

In practice, e.g. when applying spot magnetization to a ferromagnetic string of a musical instrument, it is preferred to magnetically 'wipe' the string before the application of spot magnetization. That is, it is preferred that any existing magnetic fields that may have occurred on the string, e.g., be removed first before the new radial magnetic field is applied. This may be done by using a standard video or audiotape eraser, or tape head demagnetizer.

Application of Spot Magnetization

Once spot magnetization is accomplished, one can measure the magnetic field at the surface of the string at the spot. It is convenient to express this field as the surface field times the string radius. The choice of units is immaterial, but gauss and millimeters are convenient, so this example will express a measured surface field parameter in gauss-mm as taught below.

$$FieldParameter = \frac{Field_{at_{surface}} * StringDiameter}{2}$$

The units of Field Parameter are gauss-mm or the equivalent in other units. The utility of this approach is that the magnetic field at any radial distance R measured from the string (or elongate member) center is $$\text{Field}(R) = \frac{FieldParameter}{R}$$

It is this Field (R) that is measured by the transducers of this invention. Such measurements are proportional to the instantaneous position of the string, not the velocity. It is string velocity that is sensed by other musical instrument pickups.

Measuring string position affords several advantages:

1. A signal output proportional to the playing position along the neck of the instrument can be obtained,
2. A signal output proportional to the amount of bending of a note can be obtained,
3. A signal representing the musical signal can be obtained,
4. The musical signal has 6 dB/octave greater low frequency response compared with velocity pickups, and
5. A transducer affording all of these advantages can be constructed.

Figure 12:
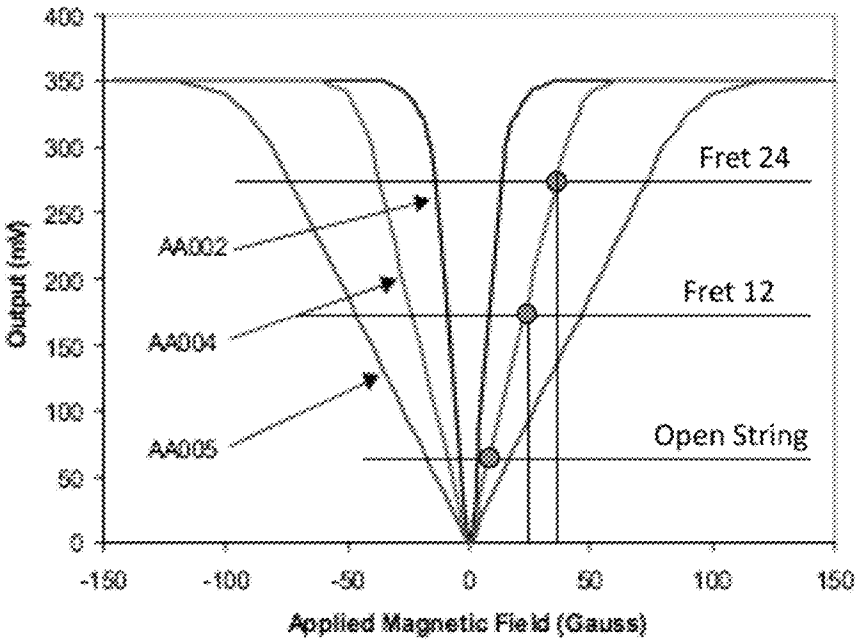
FIG. 12 is a chart showing sensitivity curves for GMR devices.

Spot magnetization is central to the transducer operation described in this document. The sensors are off-the-shelf Giant Magneto Resistive (GMR) devices, although the concept is not limited to this specific technology. Anisotropic Magneto Resistance (AMR), Colossal Magneto Resistance (CMR), or Tunneling Magneto Resistance (TMR) devices are also feasible. GMR devices are resistors that change value in proportion to the applied magnetic field. FIG. 12 shows typical GMR output voltage versus applied magnetic field for three different devices. In order to operate in the linear range, a bias magnetic field must be applied. Spot magnetization accomplishes this bias. The slope of these curves is the sensitivity of the device:

Sensitivity=>millivolts/volt/gauss

Hence the output voltage of a sensor mounted at any angle around a string will be of the form $$\text{Output} = \frac{FieldParameter * \text{Senstivity} * V_{dc}}{R}$$

where $V_{dc}$ is the DC voltage applied across the bias terminals of the GMR device.

All embodiments of the transducers taught in this document employ this concept.

A Model of Transducer Operation on an Instrument

Figure 10:
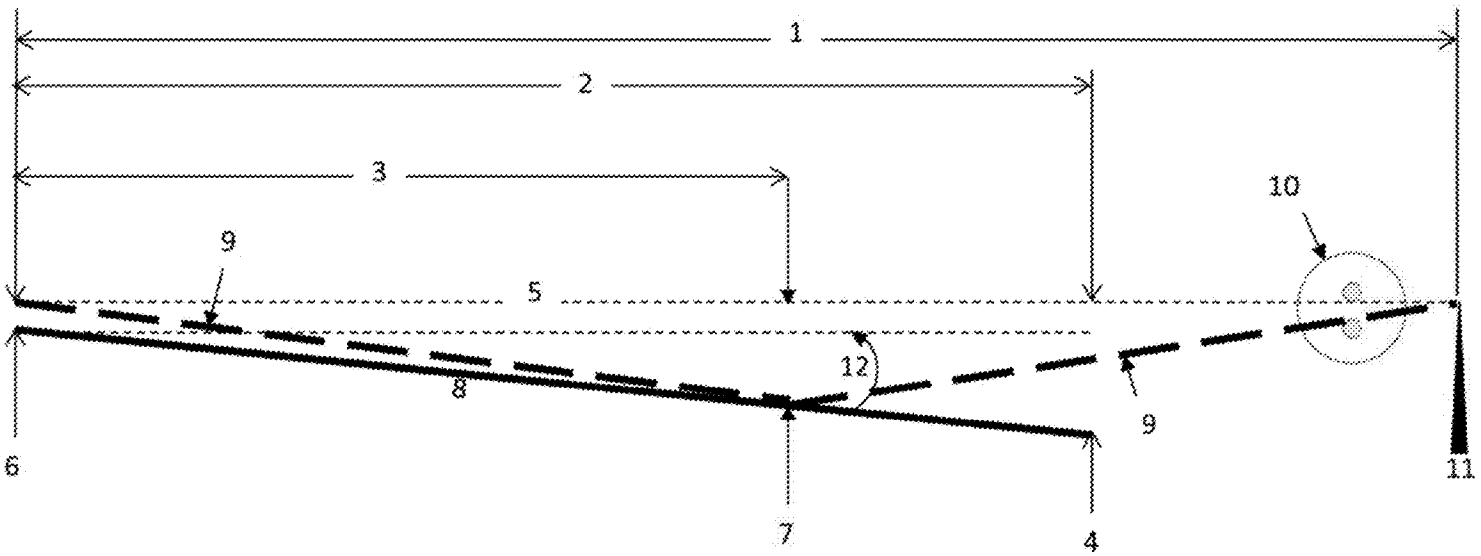
FIG. 10 is a schematic illustration for showing instrument and transducer geometry.

For musical instrument application, the invention is best described by analysis of an example musical instrument. When complete, it will be clear that the precision measurement capabilities of this invention enable one to obtain a signal that can be processed to report the play position along the neck (fret number or location on the neck and note for fretless instruments) as well as the amount of bending of any note (accomplished by the musician moving the string horizontally out of its normal position so as to raise the pitch). FIG. 10 illustrates the geometry of a typical musical instrument.

This example instrument is defined with a string length of "Scale" and fingerboard length of "3*Scale/4" (a typical 24 fret instrument). The Scale is the length of the string from the nut to the bridge. The transducer assembly is placed $D_{bp}$ in front of the bridge. The height of the open strings at fret 24 (or the highest note on the fingerboard on a fretless instrument) is $H_{24}$. The height of the strings at the nut is $H_0$. The string is played at a distance from the nut $L_{play}$. The neck makes an angle with a working line parallel to the open string of Ø.

In drawing FIG. 10, 1 is the Scale=Length of the string from Nut to Bridge, 2 is Lplaymax=3*Scale/4, and 3 is Lplay actual, the playing position along the neck. 4 is the Height of string at Fret 24=H24. Item 5 is the Open String Position. Item 6 is the height at Nut=H0 and 7 is the Height at Play Position=Hplay. Item 8 is the Fretboard surface of the Neck, and 9 is the String depressed at the location of 3. 10 represents an area of string motion detected by the transducer of this invention, 11 is the bridge and 12 represents the angle of the fretboard=Φ. When the string is depressed from open to contact the neck at $L_{play}$, the string moves down by Disp at the transducer.

A small correction trust be handled at the open string. If the string were able to be depressed to the neck at the nut it would move down by Disp0, a distance that must be subtracted to account for the height of the nut, but only for the open string or Fret 0.

Figure 11:
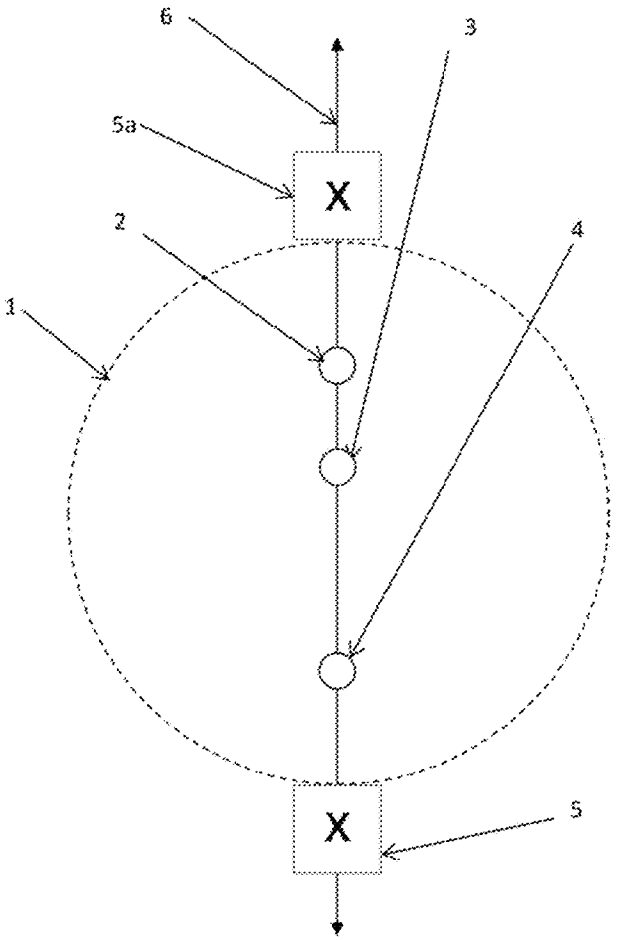
FIG. 11 is a schematic illustration of a vertically sensitive unipolar transducer.

The transducer view is shown in FIG. 11. Conceptually, the transducer is a hole of diameter Aperture through which the string passes. Ideally, the transducer is positioned so that the distance from the center of the upper sensor chip to the center of the open string is the same as the distance from the center of the lower sensor chip to the string at fret 24 or the highest playing position. This is depicted in FIG. 11.

In FIG. 11, 1 is a virtual aperture or locus of string motion 2 the open string position and 3 the string at Lplay. 4 is the string @ the 24th fret. Items 5 & 5*a* are a vertical differential sensor pair and 6 is the locus of string motion due to fret or neck position of play. FIG. 11 represents a detail of circle 10 in FIG. 10.

The string displacement Disp is calculated by use of similar triangles as seen below.

The height at any playing position $L_{play}$ is calculated using the tangent of the neck angle $$\tan\phi = \frac{H_{24} - H_0}{3 * \frac{\text{Scale}}{4}}$$

By similar triangles $$\frac{Disp}{D_{bp}} = \frac{H_{play}}{L - L_{play}}$$

where $$H_{play} = H_0 + L_{play} * \tan Ø$$

Thus, we get $$Disp = \frac{D_{bp} * H_{play}}{L - L_{play}}$$

$L_{play}$ can be expressed as a function of Fret Number from 0 to 24 (typically) as $$L_{play} = \text{Scale} * \left(1 - 2^{\frac{FretNumber}{12}}\right)$$

The maximum displacement DispMax is obtained when the string is depressed to the neck at fret 24 or the highest playing position.

The above analysis would not be possible with other transducer technologies. The novel outcome is that we teach that it is feasible to measure the play position and string bending for every string.

Sensor Operation

We will use a vertically sensitive differential transducer as depicted in FIG. 11 in this analysis. Knowing the distances between sensor and string enables us to determine the voltage output of the upper and lower sensors. The upper distance is $$\text{UpperDist} = \text{OpenString} + \text{Disp}$$

where $$OpenString = \frac{(Aperture - DispMax)}{2} + \frac{ChipSize}{2}$$

The distance from lower sensor to string is

The sensor device sensitivities are characterized in millivolts/Volt/Oe (1 Oe=1 Gauss in air) where Volt is the supply voltage across the sensor and Gauss is the applied magnetic field. The choice of units does not change the concepts taught here.

The solid-state magnetic field sensors suggested in this document are NVE Giant Magneto Resistive (GMR) AA series devices that respond to a unipolar magnetic field. In order to obtain linear operation, it is necessary to magnetically bias these devices. FIG. 12 shows the transfer functions of three of NVE's GMR magnetic field sensor chips—the AA002, AA004, and AA005. This diagram shows a typical range of magnetic field at the sensor from a string being open, at fret 24 (the highest note), and any location between. The AA004 outputs are shown. FIG. 12 makes it clear that linear operation of these GMR sensors requires that they be magnetically biased. The earlier patent had no practical means to provide this bias. Bias magnets placed under the sensor could be moved around to find a workable bias point, but when this was done on a real instrument with 4 to 6 strings, every adjustment required readjusting all the other bias magnets. It could be made to work but was not manufactureable.

Spot magnetization enables this self-bias and eliminates any need for the use of biasing permanent magnets as part of the transducer assembly. The approaches taught in Nelson U.S. Pat. No. 6,271,456 required such bias magnets and were impractical for mass production. Spot magnetization enables this approach to be implementable and practical.

Recall that we characterize each string based on its Diameter and the magnetic field at the string surface as $$FieldParameter = \frac{Gauss_{at_{surface}} * StringDiameter}{2}$$

The upper sensor output voltage is then $$UpperSensorOutput = \frac{\text{Voltage} * \text{Sensitivity} * FieldParameter}{UpperDist}$$

whereas the lower sensor output voltage is $$LowerSensorOutput = \frac{\text{Voltage} * \text{Sensitivity} * FieldParameter}{LowerDist}$$

Figure 20:
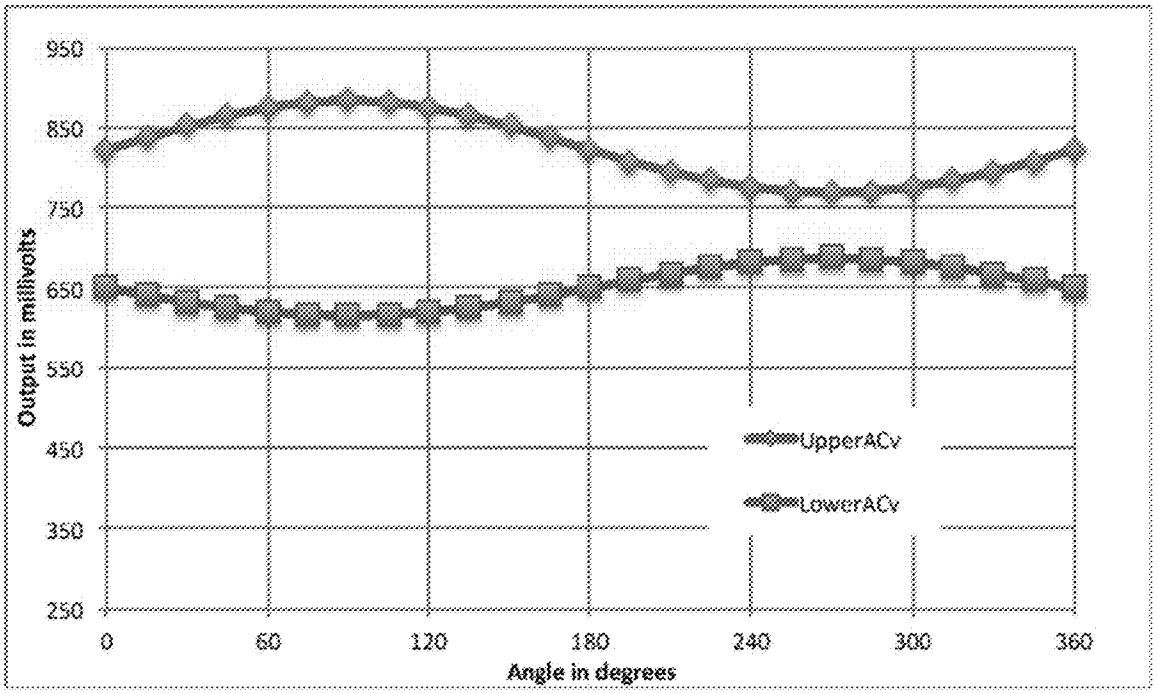
FIG. 20 is a chart showing upper and lower sensor output signals.

The differential output voltage is the difference between upper and lower. This doubles the signal output while increasing noise by square root of 2. The order of subtraction is not relevant to the nature of this invention, but determines the sign of the result. In this example, as shown in FIG. 20, we see the signals for upper and lower sensors, and then in FIG. 21, we take UpperSensorOutput−LowerSensorOutput to obtain the differential output.

Figure 24:
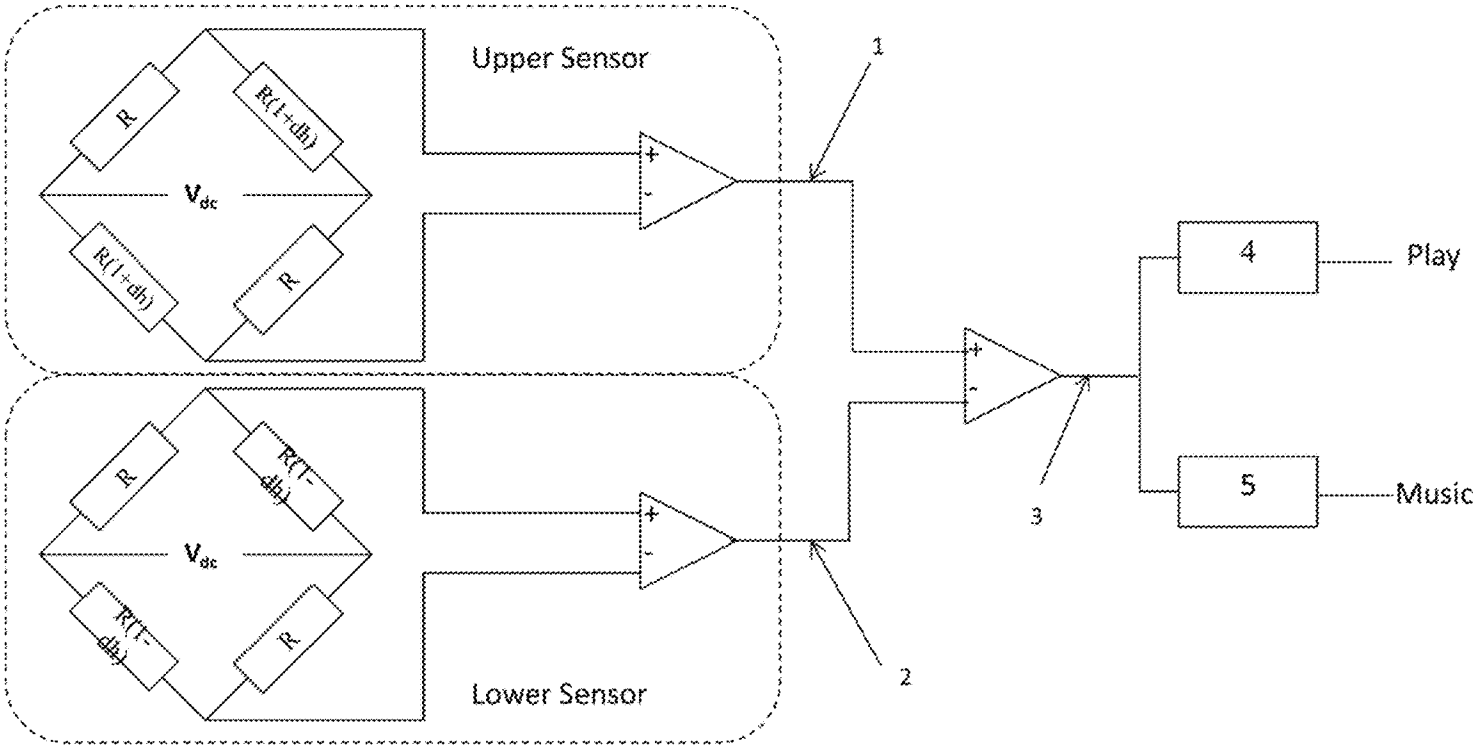
FIG. 24 is a schematic illustration of a differential sensor with two elements like FIG. 23 with a differencing amplifier.

FIG. 24 shows a differential signal processed by a low-pass filter to isolate a low frequency signal that is proportional to playing position, while a BandPass Filter isolates a higher frequency signal that represents the musical signal. We can assume that that musical signal is small enough to be accurately represented as first order variation around the playing position. High pass and low pass filters can separate the playing position signal from the musical signal. In FIG. 24, there is shown an upper sensor output signal 1, a lower sensor output signal 2, a differential output signal 3, a low-pass filter 4 that captures the play position signal and a band-pass filter that captures the musical output signal.

Figure 13:
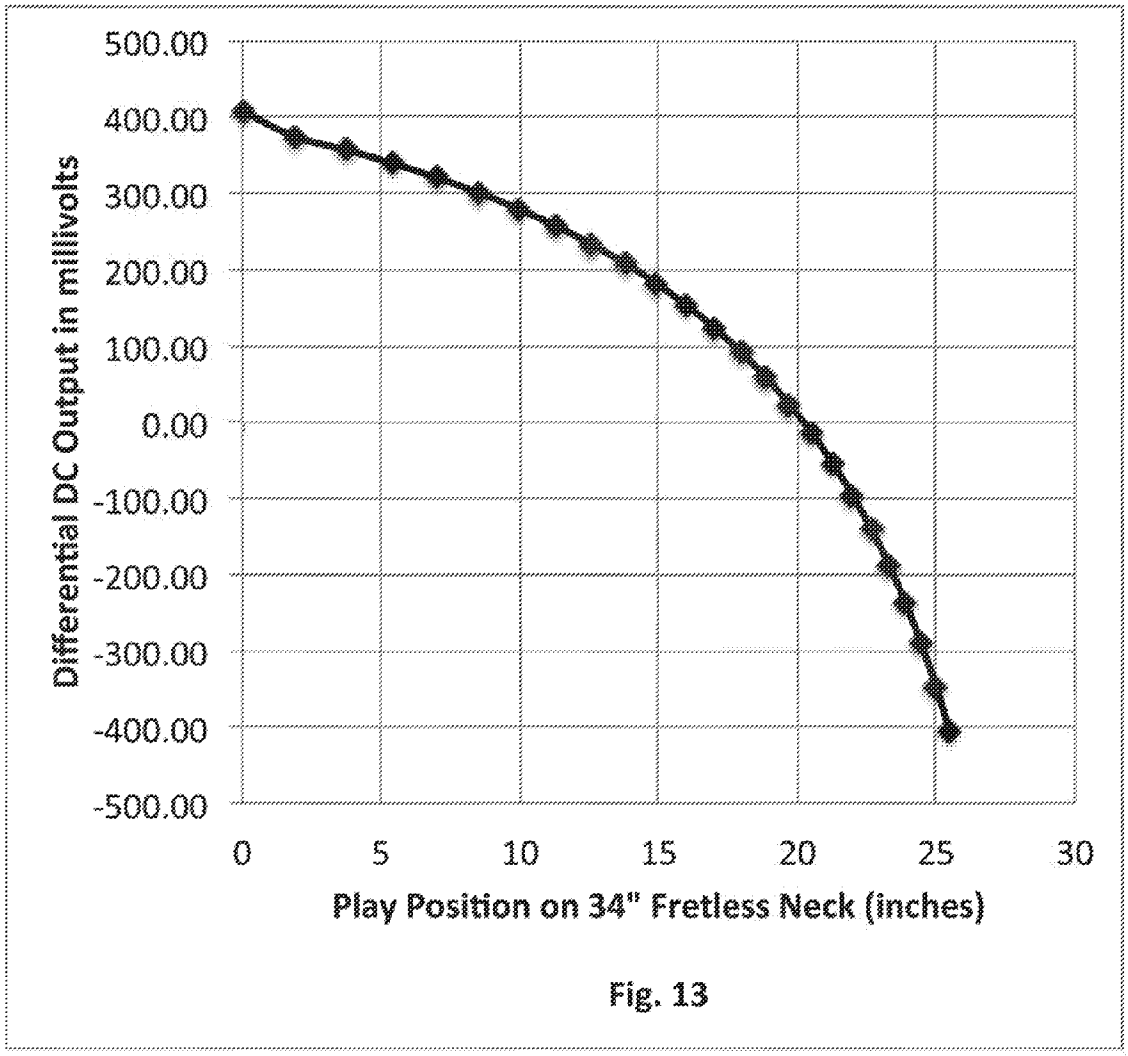
FIG. 13 is a chart showing differential DC output as a function of playing position.

FIG. 13 shows a simulated low-pass filter output as a function of playing position. Converting from an electrical signal to equivalent playing position can be accomplished by Analog to Digital Conversion of the signal and employing an algorithm that compares a measured value with a 24-entry table with values for each fret and returns the index of the closest match that corresponds to the played fret. The curve can also be approximated by a polynomial that can be solved to convert output voltage to fret or note. This capability is a novel outcome of spot magnetization combined with radial field measurement as described in this invention.

This description has focused on a single axis transducer with vertical sensitivity. However, the axis of sensitivity can be rotated to any desired angle, either physically or electrically. For example, a physical rotation to 45° can be useful on a bass instrument because it responds equally to horizontal and vertical excitation such as Arco (bowing-horizontal) or Slap (vertical).

Dual axis transducers employ a pair of single axis mounted at right angle to one another. A complete characterization of string motion actually requires measurement on two orthogonal axes, that is the differential equations that model string motion use two dimensional or complex numbers. The transducers of this invention can measure two dimensions of motion that can be played as a stereo signal. The resulting sound is improved based on testimonials of musicians and audio engineers.

AC or Musical Responses

Figure 19:
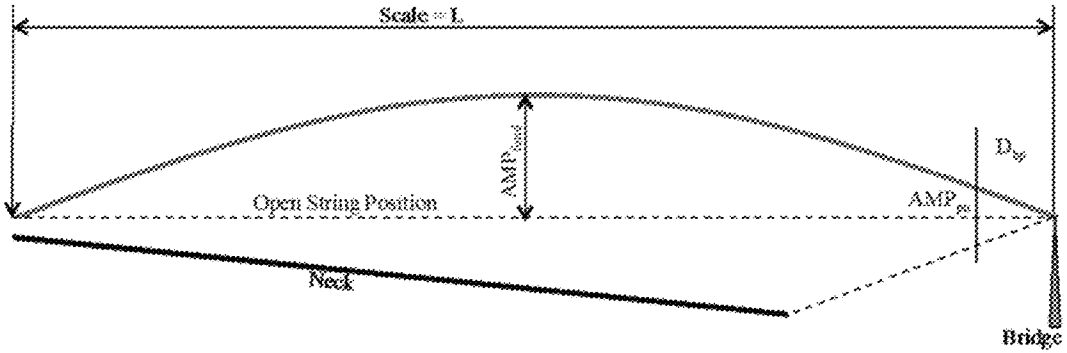
FIG. 19 illustrates open string vibration displacement at the location of the transducer.

We can model the string motion for musical purposes as a sinusoid representing the open string fundamental with amplitude at Fret 12 of AmpFund. This is depicted in FIG. 19 which shows the details of this string vibration within the transducer aperture. The string motion at the pickup is $$AMP_{pu} = AMP_{fund} * \sin\left(\pi * \left(1 - \frac{D_{bp}}{\text{Scale}}\right)\right)$$

Figure 21:
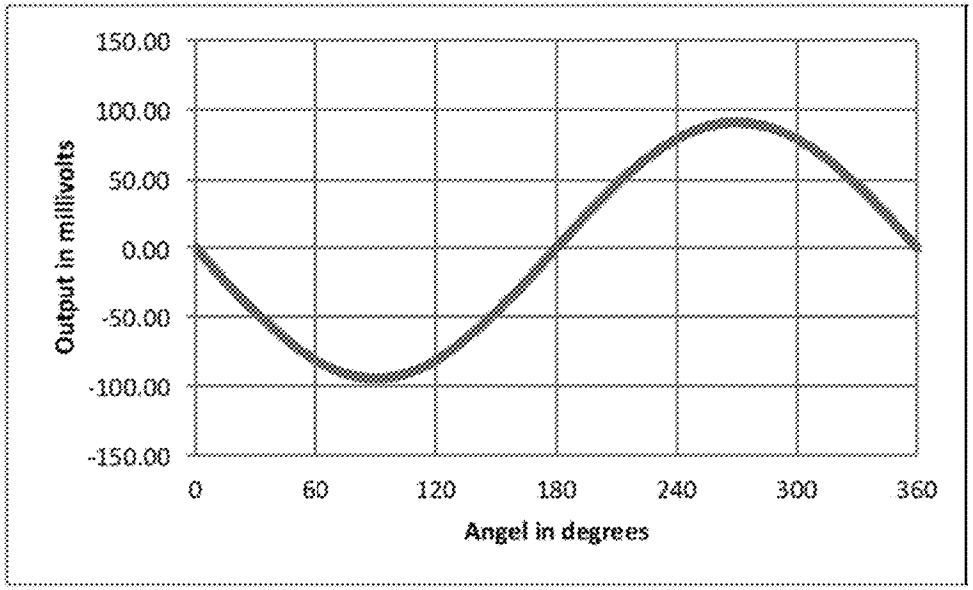
FIG. 21 is a chart showing differential output in millivolts.
Figure 22:
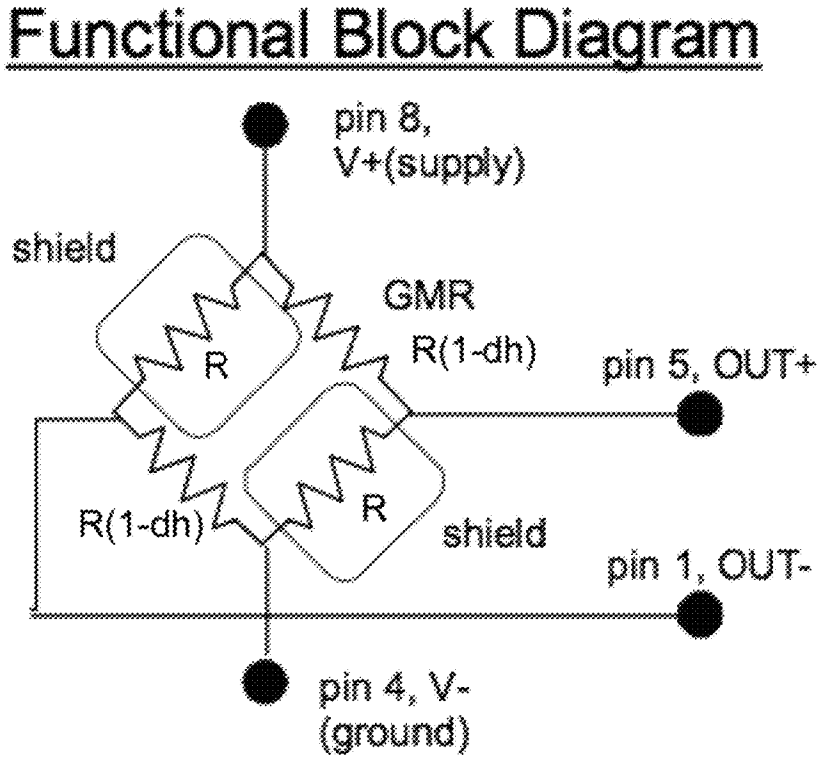
FIG. 22 illustrates a functional block diagram of a Wheatstone bridge sensor device.

FIG. 20 shows a typical signal from the upper and lower sensors of a transducer of type shown in FIG. 11 for one cycle of a string vibration independent of frequency. FIG. 21 shows the differential output.

Embodiments

Because magneto-resistive devices are sensitive to one component of the applied magnetic field, the physical placement of the sensor devices around the string determines the axis of sensitivity. Accordingly, this invention allows embodiments that capture specific components of string motion.

Figure 14:
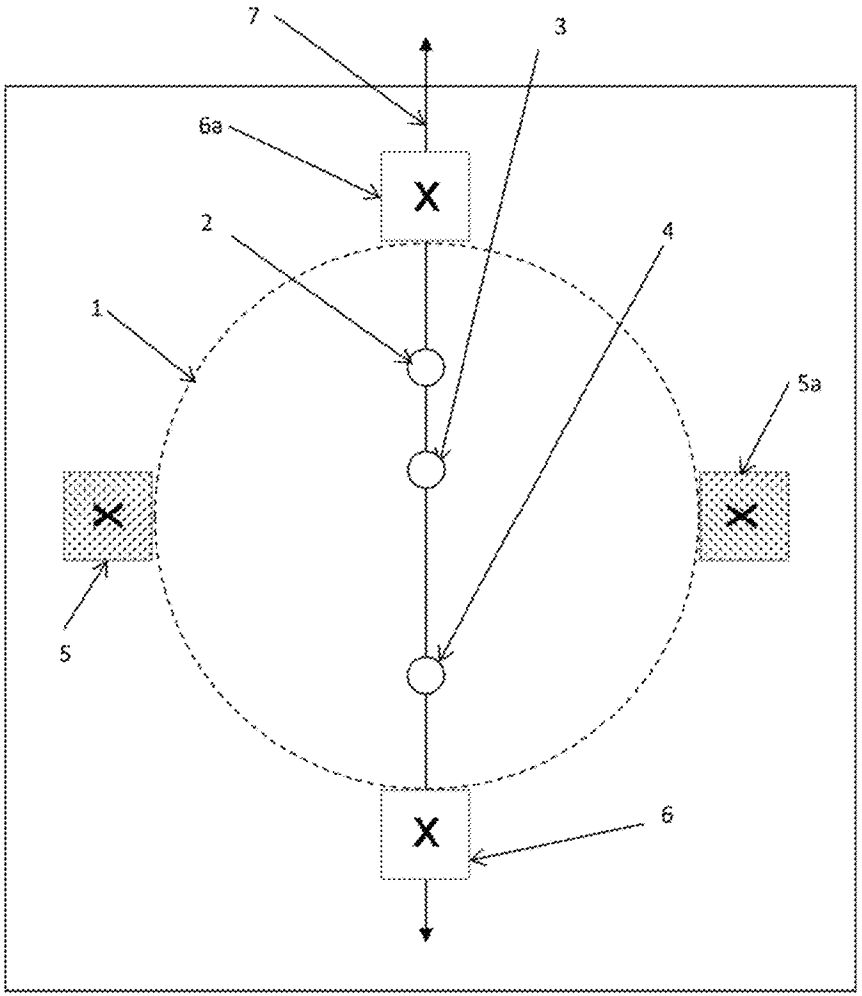
FIG. 14 illustrates a quadrature transducer with horizontal and vertical sensitivity.
Figure 15:
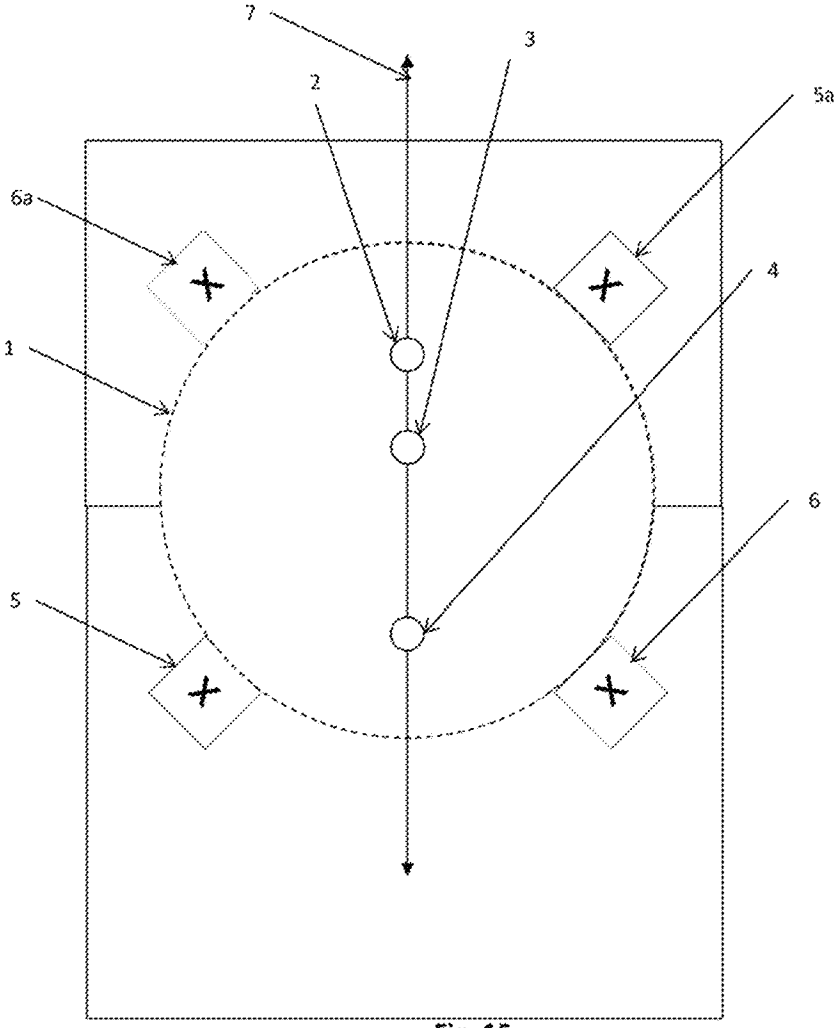
FIG. 15 illustrates a quadrature transducer with sensitivities at +45 and −45 degrees.

FIGS. 14 and 15 show quadrature transducers with horizontal and vertical sensitivity and with sensitivities at +45 and −45 degrees, respectively. In both figures, 1 is a virtual aperture or locus of string motion, 2 the open string position, 3 the string at Lplay, and 4 the string @ the 24th fret. 5 & 5*a* are a differential sensor pair, and 6 & 6*a* are a differential sensor pair (the pairs are horizontal and vertical in FIG. 14, and +45 and −45 in FIG. 15). Item 7 is the locus of string motion due to fret or neck position of play.

Figure 16:
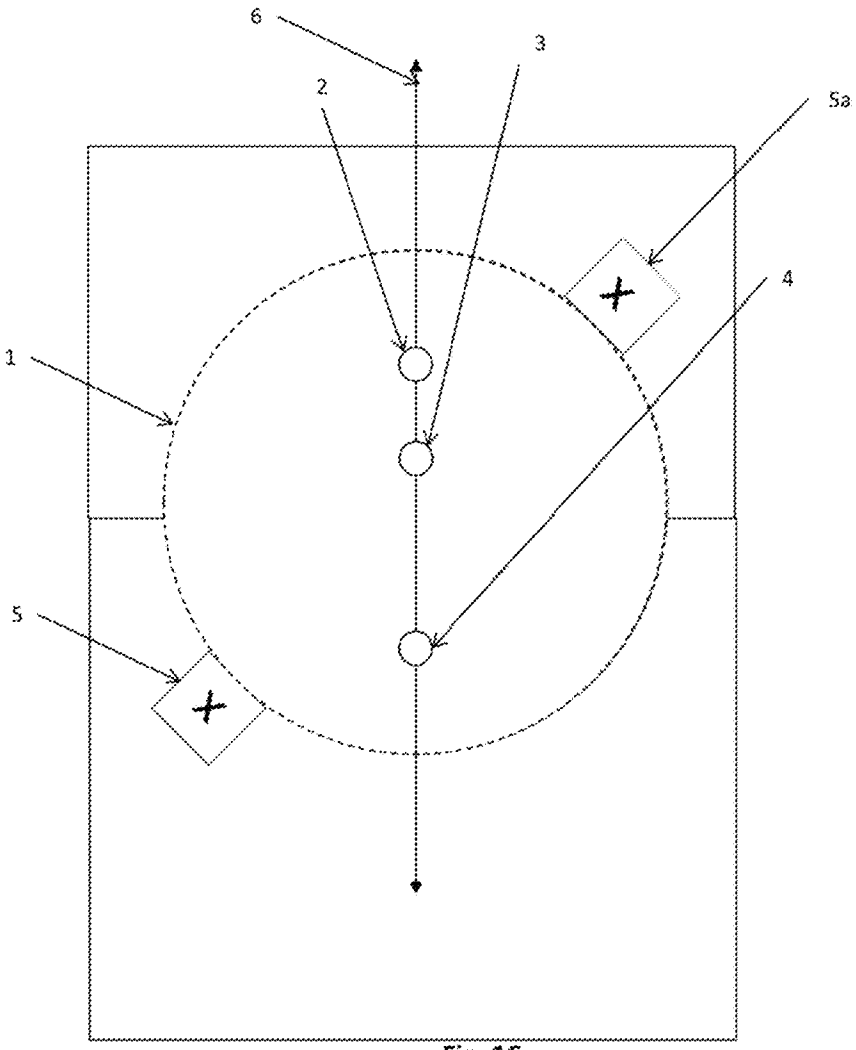
FIG. 16 illustrates a single axis differential transducer at 45 degrees.

FIG. 16 is similar but has a single differential sensor pair 5 and 5*a* at +45, and 6 is the locus of string motion due to fret or neck position of play.

Figure 17:
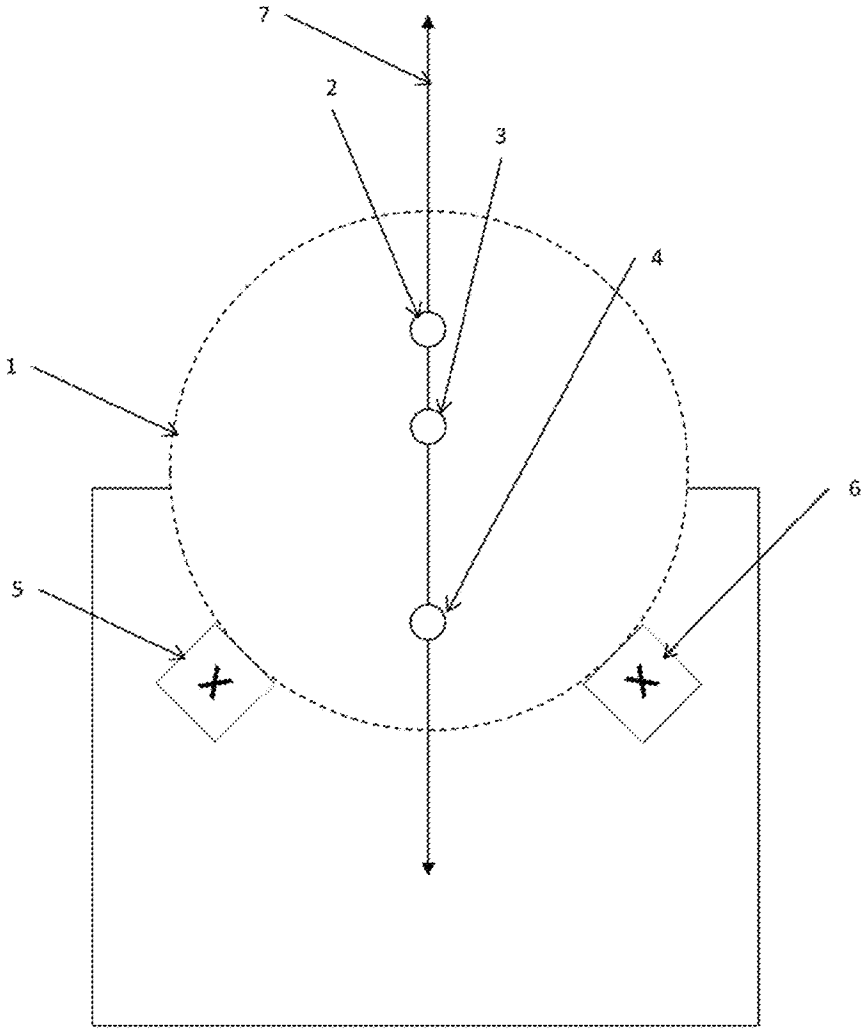
FIG. 17 illustrates a dual axis under-string transducer.

FIG. 17 has differential sensors 5 and 6 at +45 and −45, and 7 is the locus of string motion due to fret or neck position of play.

Single Axis (Mono) Transducers

Single axis transducers capture one component of string motion.

Under-String Implementations

Under-string implementations are less expensive to build and have lower fidelity to string motion than differential versions.

A first under-string embodiment is a single axis transducer with one sensor directly under the string. This embodiment is sensitive to the vertical component of string motion and can therefore sense both playing position and musical signals, albeit with less fidelity than differential transducers described below.

FIG. 17 shows a second embodiment that is a single axis under-string transducer but with the sensor at an angle of +45 or −45 degrees. Either sensor 5 or sensor 6 would be in place for this embodiment, but not both. This configuration responds equally to horizontal or vertical components of string motion and thus cannot respond to play position. This would be a desirable low-cost embodiment for bass or cello instruments.

Vertical and horizontal sensitivities are desirable because bowing the instrument strings excites horizontal motion; vertical motion is excited by slap style. Individual musicians may prefer other angles.

Differential Single Axis (Mono) Transducers

Another embodiment is to add a second sensor above the string and take the difference between the two sensors. This improves linearity and signal fidelity to string motion, and is more expensive to build.

One differential single-axis embodiment is to place one sensor above and a second below the string along the vertical axis or along a radial of the radius of curvature of the bridge for that string. This embodiment is sensitive to the vertical component of string motion and can therefore sense both playing position and musical signals, with greater fidelity than under-string single axis embodiments mentioned above. See FIG. 14 with only sensors 6 and 6*a* in place.

Another embodiment is to rotate the axis of sensitivity to +45 or −45 degrees. See FIG. 15 with either sensors 5 and 5*a*, or sensors 6 and 6*a*, but not both. This embodiment provides equal response to either horizontal or vertical excitation, but cannot generate a separate signal output in response to playing position or note bending.

Quadrature (Dual Orthogonal Axis) Stereo Transducers

Under-String Quadrature (Stereo)

FIG. 17 shows an under-string embodiment that employs two sensors at +45 and −45 degrees and thereby generates a two-channel or stereo output. This embodiment fully captures the two-dimensional details of string motion.

If the two outputs are summed, the result is the vertical component of string motion. Differencing produces the horizontal component of string motion. Therefore, electrical signal sum and difference processing can rotate the axes of sensitivity rotated by 45 degrees. Weighted sums and differences can produce any desired angle of rotation.

Differential Quadrature (Stereo)

A preferred differential quadrature embodiment shown in FIG. 15 is an improvement on the FIG. 17 that adds a second pair of orthogonal sensors above the strings and differences the outputs. This FIG. 15 embodiment has two advantages:

1. The geometry makes the transducer narrower than Horizontal-Vertical embodiment of FIG. 14, and
2. The axes of sensitivity of sensors for adjacent strings on a multi-string instrument will be close to perpendicular to the radial field of the neighboring string. This will reduce adjacent string cross talk.

Quadrature implementations as shown in FIGS. 14, 15, and 17 have a separate output signals for the two orthogonal string motion components. It is then possible to obtain a vertical signal and a horizontal signal. On an acoustic bass or cello, vertical string motion causes the instrument top to move up and down, while horizontal motion causes lateral "rotation" of the bridge that excites higher vibratory modes. Transducing these separate components of string motion and amplifying them as a stereo signal improves the sound quality. If the two components are cross-plotted as X and Y signals on an oscilloscope, the pattern is very complex indicating that one component is not a simple relationship to the other.

FIG. 14 shows a quadrature transducer that responds to vertical and horizontal components of string motion.

FIG. 15 shows a dual axis transducer at +45 or −45 degrees that also responds to both components of motion. This quadrature embodiment rotates the sensor axes by 45 degrees. This configuration reduces the width of the individual string transducer and makes it possible to mechanically and electrically separate the lower half from the upper half. This allows the removal of the upper half for servicing the strings, as opposed to fishing them through the apertures.

Another feature of quadrature transducers is that it is feasible to devise a means to rotate the angle of sensitivity electronically or by digital signal processing. In practice, adding the +45 and −45 signals yields the vertical signal, and differencing them yields the horizontal signal. Any angle of sensitivity can be produced with different multipliers and signs on the two signals. No other transducer offers these capabilities.

A quadrature transducer with horizontal and vertical outputs can produce signals proportional to both playing position and note bending.

In addition, the solutions of the differential equations of string motion are complex variables with orthogonal components as real and imaginary parts of the signal. Hence, orthogonal transducers of this invention capture all the necessary aspects of the string motion. The low frequency output for the vertical axis captures playing position. The low frequency output for the horizontal axis captures any bending of the string while playing. No other transducer has these unique capabilities.

Implementations

Electronic Implementation

Conventional Wheatstone Bridge Implementations

Figure 23:
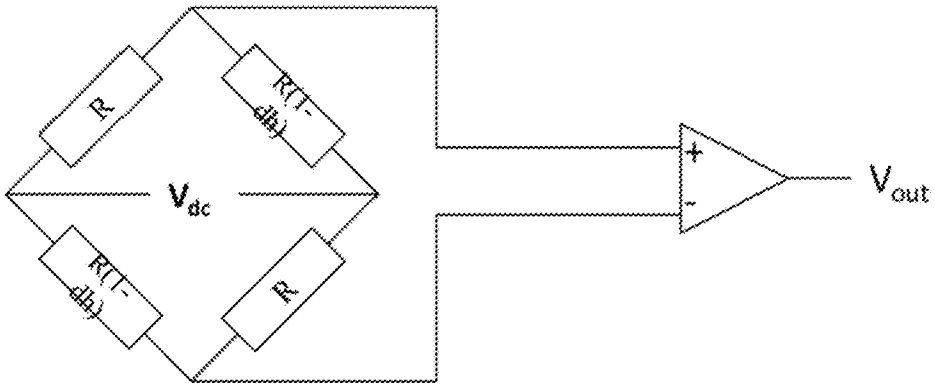
FIG. 23 illustrates a simple magnetic field sensor circuit with one sensor and one operational amplifier.

The GMR sensor chips from the vendor NVE are implemented as Wheatstone Bridges with outputs that can be processed by a differential input amplifier such as an instrumentation amplifier or operational amplifier. Thus, perhaps the simplest implementation of a unipolar transducer, shown in FIG. 23, could be implemented with an off-the-shelf sensor from the vendor NVE. The vendor specified output resistance of the bridge is 5000 ohms, which is the resistance of each of the individual internal resistances. Accordingly, the thermal noise at the amplifier inputs is determined by this value.

The single axis differential transducers taught earlier can be implemented by using two instances of the unipolar design. This is depicted in FIG. 24. These differential embodiments use two sensor chips. The thermal noise from two devices can be treated as statistically independent while the output doubles. Accordingly, differential implementations have their thermal signal to noise ratio improved by 3 dB.

A preferred implementation is depicted in FIG. 17 and FIG. 15. A printed circuit board is constructed that can be populated with one or two sensors for use under the strings as in FIG. 17. A module of the same design can be rotated 180 degrees and placed above the strings to function as the second half of the differential transducer FIG. 15. In this manner, one basic design can be populated and implemented to provide all four possible implementations as depicted in the table of FIG. 18.

In addition by making the upper half removable, the strings can be serviced without fishing them through a hole. In addition, with the top half removed, it is simple to spot magnetize a new string.

Figure 8:
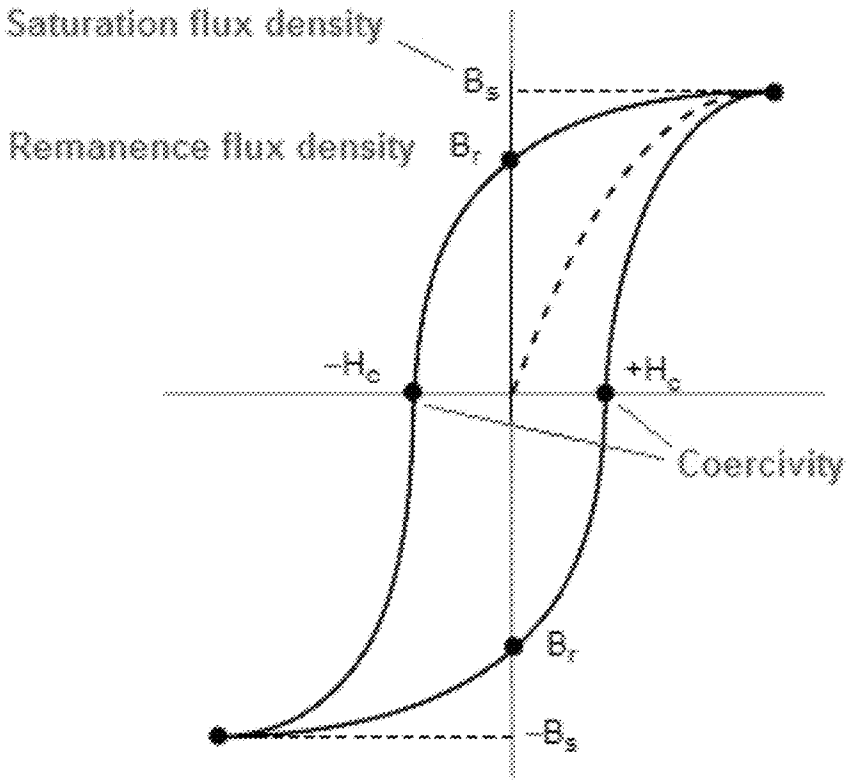
FIG. 8 is a typical magnetic saturation curve.

The preferred embodiment for a magnetization tool (depicted in FIG. 7) uses electromagnets. With the top half the above-mentioned transducer removed, each string can be spot magnetized by placing the center of the three magnets above the sensor chip of the installed lower half. A pulse of current will exceed the saturation flux density of the ferromagnetic string material as shown in FIG. 8. When the pulse ends, the applied field goes to zero, but the string retains a permanent magnetic spot and two opposite polarity spots due to the presence of the outer electromagnets of the tool of FIG. 7.

A Full Bridge Using Two Anti-Parallel Sensor Chips

Figure 25:
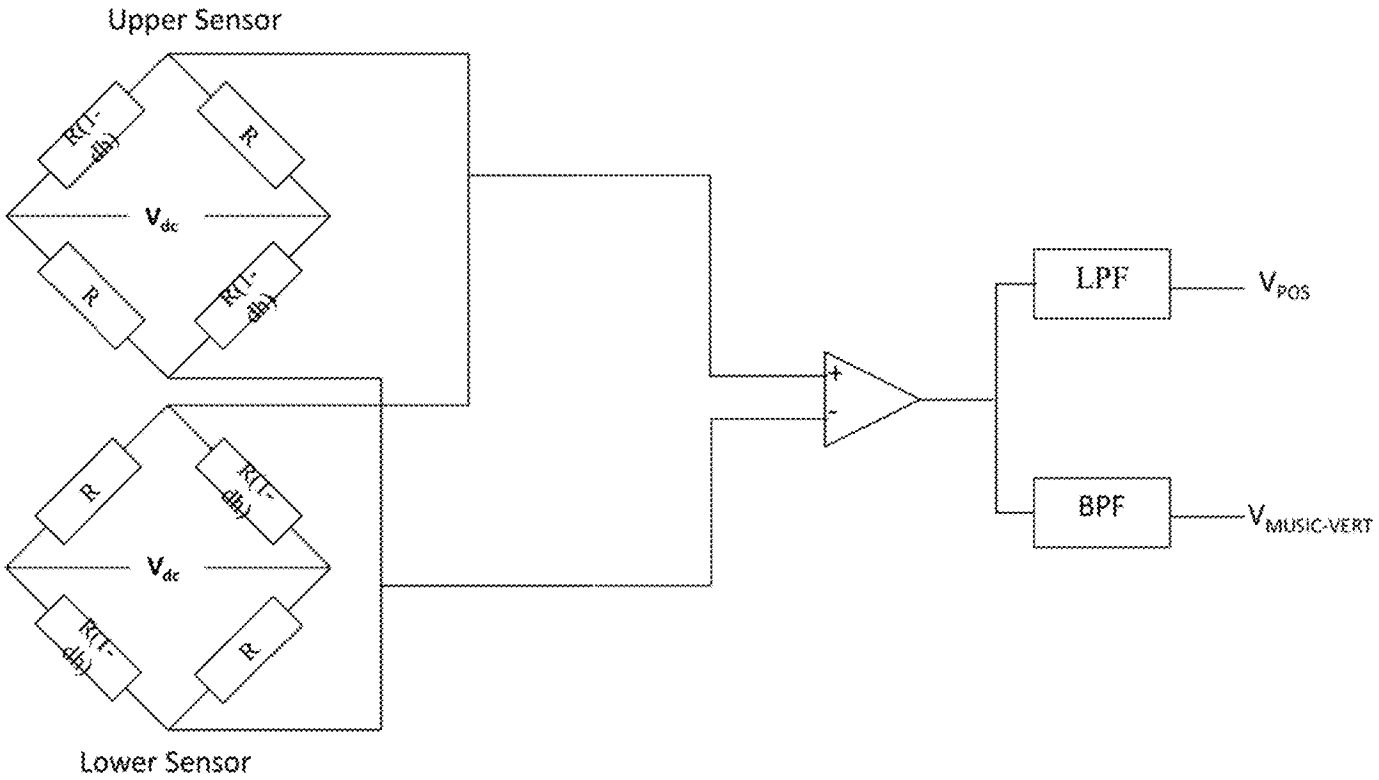
FIG. 25 illustrates a differential single axis transducer using two anti-parallel or back-to-back sensors.

FIG. 25 shows a way to use two standard NVE magnetic field sensor chips back-to-back or anti-parallel so the result operates as if it were a full bridge with four active sensors. Conventional NVE Wheatstone bridges are half-bridges with two active and two passive resistors per bridge. A full bridge has four active resistors, and no passives. But the opposite pairs must respond in opposite directions, and GMR resistors respond to the magnitude of the field, not the sign. Accordingly, full bridges are not feasible with GMR technology, except in this specific case where we put one pair of resistors on each side of a magnetic field source. As the string moves back and forth, the two sides respond in opposite sense. Accordingly a full bridge could be constructed in principle, but not with off-the-shelf parts. This FIG. 25 implementation creates a full bridge at the cost of having each active resistor in parallel with a passive resistor.

This approach has been successfully implemented using AA002*s* with 5000-ohm resistance. The source resistance of the differential sensor is 2500 ohms so the thermal noise floor cannot be less than the noise of an ideal 2500-ohm resistor. Compare this with the similar implementation of FIG. 24 that would have source resistance of 5000 ohms for each half of the differential pair. Best case thermal noise for that configuration is square root of 2 times 5000.

Current Source with Gain and Reduced Thermal Noise

Figure 27:
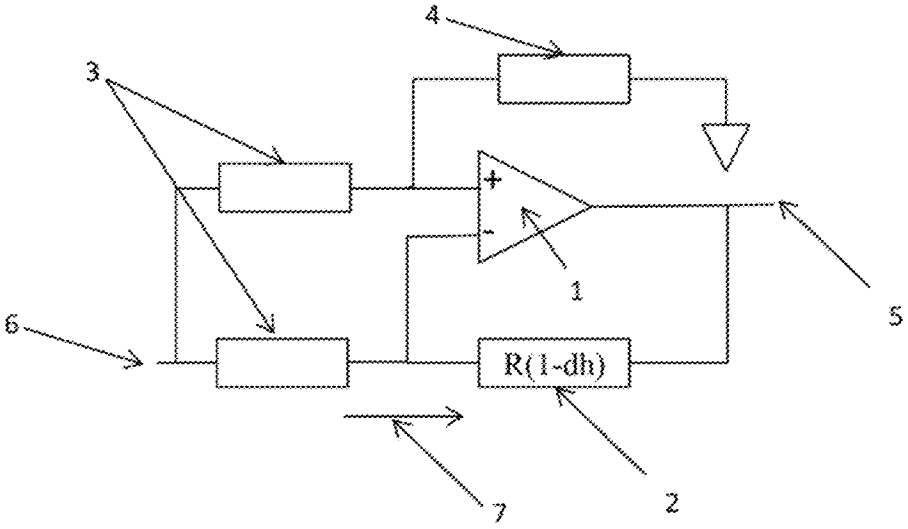
FIG. 27 is a schematic illustration of single GMR resistor.

FIG. 27 shows a novel circuit that uses a single GMR resistor (2) in the feedback loop of an operational amplifier (1). The OpAmp is implemented as a conventional differential amplifier with the same input voltage (6) on both inputs. Ordinarily, this would be an uninteresting result, but the input bias voltage (6) divided by a resistance (3) generates a constant current (7) that passes through the GMR (2). As magnetic field is applied, the resistance of (2) is reduced which reduces the output. This circuit modulates the gain of the circuit to obtain its output. While the half bridges of conventional sensors are slightly non-linear, this implementation is fully linear.

Figure 26:
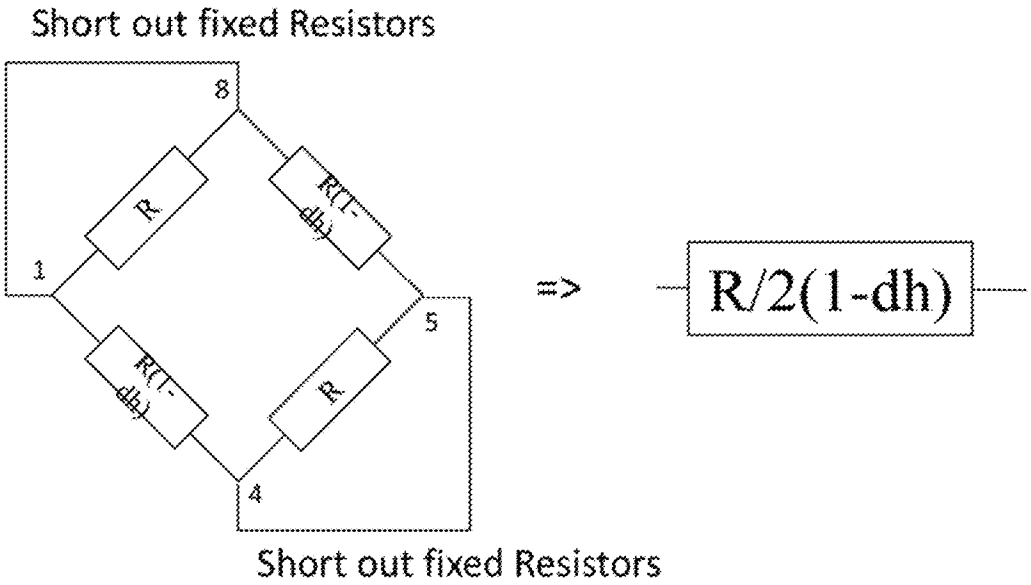
FIG. 26 is a schematic illustration of a sensor that shorts out the fixed resistors to make a single GMR element of R/2.

All these transducer implementations require about 20 dB to 40 dB of gain that must be added after the thermal noise floor of the source resistance is established. With this circuit, the gain can be obtained by reducing the values of the input resistor (3). The single GMR resistor can be obtained as shown in FIG. 26 by shorting out the passive resistors. This necessarily puts the two active resistors in parallel, so for the same 5000-ohm parts of earlier examples, we get a GMR of 2500 ohms. To obtain a gain of 10, the resistor values (3) would be 2500/10 or 250 ohms. In this case the thermal noise becomes close to the sum of the two input resistors (3) or 500 ohms.

This is a preferred implementation for now it is feasible to use a 30 k ohm part that becomes 15 k in the feedback loop. For a gain of 100 (40 dB), the input resistors are 150 ohms and the thermal noise floor is about 300 ohms.

Mounting for Acoustic Upright Bass

When present pickups (usually employing piezo materials) are mounted on acoustic upright basses, virtually all players agree that the resulting sound has pickup personality that is undesirable. The reproduced sound is not identical to the natural sound of the instrument.

The transducers of this invention can be mounted to an acoustic upright bass 1 (see FIG. 28) in a manner that captures virtually all the complex motions of the strings and the instrument body. The most acoustically inert point on a bass is where the neck attaches to the body. Ideally, a cantilever beam 5 would be attached to this point. A close approximation to ideal is to affix a stiff cantilever beam 5 to the underside of the uppermost portion of the fingerboard that extends down to approximately one inch above the bridge 2, and to attach the transducers a to the beam at that point. With the transducers so mounted, the motion of the strings plus the motion of the instrument top in response to string excitation can be sensed. The signals transduced by this method capture the natural sound of the instrument. The top of the body can move vertically and horizontally from string excitations and is thus not desirable as a mounting point. Likewise, mounting the transducers to the bridge fails to capture the natural sound of the instrument. The combination of spot magnetization with magnetoresistive transducers and this novel mounting technique results in sonic fidelity heretofore unachievable. The amplified sound is essentially identical to the unamplified sound except louder.

Figure 28:
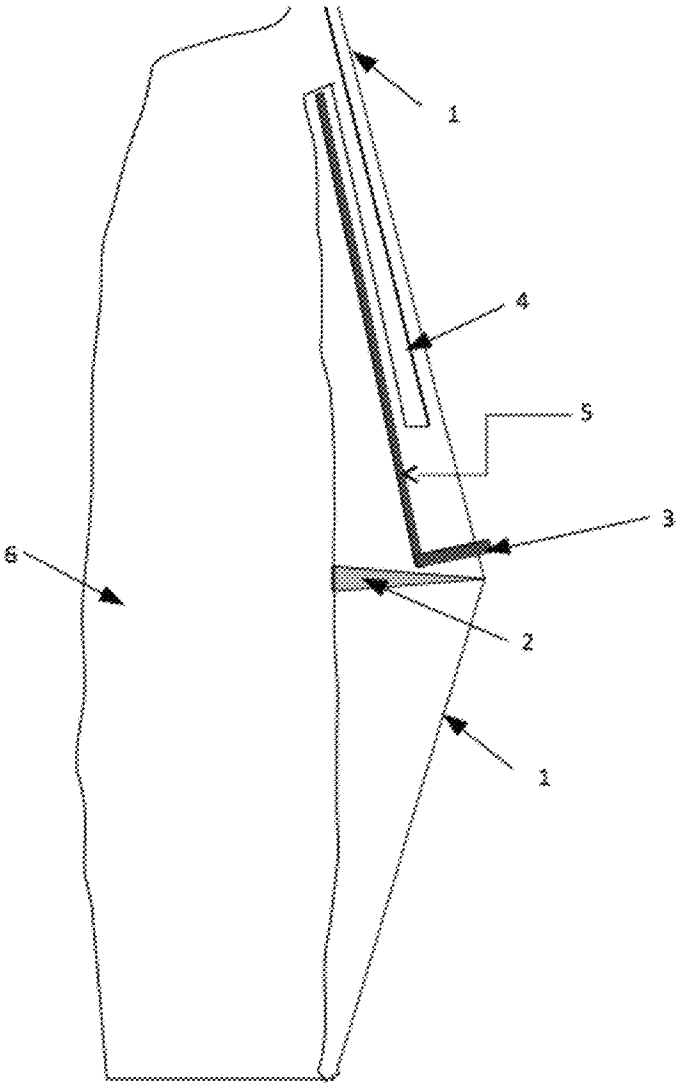
FIG. 28 is a schematic illustration of an upright bass with a butt block mount for a transducer according to the present invention.

The mounting involves firmly attaching a carbon fiber rod to the butt block and extending it along the center of the instrument to a point just in from of the bridge. The transducer assembly is attached to the rod extending upward to put apertures in their correct locations. The rod stiffness and mass, and the mass of the transducer assembly are designed so that any natural resonances are above the audible range and hence do not affect the tonality of the output. By this means, the orthogonal transducer of this invention senses motion of the top and strings as well as any vibrations of the neck. This is schematically illustrated in FIG. 28.

The fidelity of this bass pickup rivals that of a studio microphone. This performance is achievable because of the precision measurement capability afforded by discovery of the method to produce the disk of magnetic field described in this invention.

While specific examples of the invention have been described above with respect to application to a stringed musical instrument, such as a stand-up bass, the invention may be applied to other situations in which there are a need to accurately detect the position of an elongate ferromagnetic member.

The invention claimed is:

1. A method of detecting a position of an elongate member, comprising:

creating a radial magnetic field at a spot along the elongate member in which the magnetic field has radial field lines that decay as 1/R, where R is a distance from the center of the elongate member along a radial field line perpendicular to an axis of the elongate member, with the spot having a first pole of N or S polarity, and the elongate member having poles of the opposite polarity spaced along the elongate member on opposite sides of the first pole of the radial magnetic field located at the spot; and then detecting motion of the spot using at least one magnetic field sensor positioned proximal to the spot along the elongate member and electrically amplifying output of the sensor.

2. The method of claim 1, wherein:

the elongate member comprises a ferromagnetic string of a musical instrument;

said creating comprises magnetizing the spot along the string by bringing one pole end of a bar magnet into contact with the string and slowly removing the one pole end such that the spot is magnetized to a pole orientation opposite to that of the one pole end, whereby pole orientations opposite to that of the spot are created along the string both above and below the spot so as to create the magnetic field that approximates a disk shape with radial field lines that decay as 1/R.

3. The method of claim 2, wherein said detecting comprises one said sensor being located directly under the string and responding to vertical components of string motion.

4. The method of claim 2, wherein said detecting comprises the at least one sensor including a plurality of sensors that are located at +45 degrees or −45 degrees with respect to a line from a fretboard of the musical instrument to the string.

5. The method of claim 1, wherein:

the elongate member comprises a ferromagnetic string of a musical instrument;

said creating comprises magnetizing the spot along the string using an electromagnet such that the spot is magnetized to a pole orientation opposite to that of one pole of the electromagnet, whereby pole orientations opposite to that of the spot are created along the string both above and below the spot so as to create the magnetic field that approximates a disk shape and with radial field lines that decay as 1/R.

6. The method of claim 2, wherein the at least one sensor comprises a plurality of magnetic field sensors that are used in said detecting the motion of the spot, the plurality of magnetic field sensors forming a quadrature string motion transducer that includes two unidirectional transducers mounted at right angles proximal to the spot along the string.

7. The method of claim 2, wherein the at least one sensor is mounted on a rod that is fixed to a butt block of the musical instrument.

8. The method of claim 1, wherein:

the elongate member comprises a ferromagnetic string of a musical instrument;

said creating comprises magnetizing the spot along the string by bringing three poles of a linear magnet arrangement, in which arrangement a middle pole has a polarity opposite to that of two end poles, simultaneously into contact with the string and slowly removing the three poles such that the spot is magnetized to a pole orientation opposite to that of the middle pole and pole orientations opposite to that of the spot are created along the string both above and below the spot so as to create the magnetic field that approximates a disk shape with radial field lines that decay as 1/R.

9. A single axis position transducer for detecting a position of an elongate member comprising:

an apparatus for creating a radial magnetic field at a spot along the elongate member in which the magnetic field has radial field lines that decay as 1/R, where R is a distance from the center of the elongate member along a radial field line perpendicular to an axis of the elongate member, with the spot having a first pole of one polarity, and the elongate member having poles of the opposite polarity spaced along the elongate member on opposite sides of the first pole of the radial magnetic field located at the spot; and at least one magnetic field sensor positioned proximal to the spot along the elongate member that detects motion of the spot and electrically amplifies output of the sensor.

10. The transducer of claim 9, wherein:

the elongate member comprises a ferromagnetic string of a musical instrument; and said apparatus comprises a bar magnet for magnetizing the spot along the string by bringing one pole end of the bar magnet into contact with the string and slowly removing the one pole end such that the spot is magnetized to a pole orientation opposite to that of the one pole end, whereby pole orientations opposite to that of the spot are created along the string both above and below the spot so as to create the magnetic field that approximates a disk shape with radial field lines that decay as 1/R.

11. The transducer of claim 10, wherein one said sensor is located directly under the string and responds to vertical components of string motion.

12. The transducer of claim 10, wherein the at least one sensor comprises a plurality of sensors that are located at +45 degrees or −45 degrees with respect to a line from a fretboard of the musical instrument to the string.

13. The transducer of claim 9, wherein:

the elongate member comprises a ferromagnetic string of a musical instrument;

said apparatus comprises an electromagnet for magnetizing the spot along the string such that the spot is magnetized to a pole orientation opposite to that of one pole of the electromagnet, whereby pole orientations opposite to that of the spot are created along the string both above and below the spot so as to create the magnetic field that approximates a disk shape and with radial field lines that decay as 1/R.

14. The transducer of claim 10, wherein the at least one magnetic field sensor comprises a plurality of magnetic field sensors that form a quadrature string motion transducer that includes two unidirectional transducers mounted at right angles proximal to the spot along the string.

15. The transducer of claim 10, wherein the at least one magnetic field sensor comprises a plurality of magnetic field sensors that are mounted on a rod that is fixed to a butt block of the musical instrument.

16. The transducer of claim 10, wherein:

said apparatus comprises a linear magnet arrangement having three poles, in which arrangement a middle pole has a polarity opposite to that of two end poles, for magnetizing the spot along the string by bringing the three poles simultaneously into contact with the string and slowly removing the three poles such that the spot is magnetized to a pole orientation opposite to that of the middle pole and pole orientations opposite to that of the spot are created along the string both above and below the spot so as to create the magnetic field that approximates a disk shape with radial field lines that decay as 1/R.

17. A musical instrument having a single axis position transducer for detecting a position of a string of the instrument, comprising:

a stringed musical instrument having at least one ferromagnetic string;

an apparatus for creating a radial magnetic field at a spot along the at least one ferromagnetic string in which the magnetic field has radial field lines that decay as 1/R, where R is a distance from the center of the at least one ferromagnetic string along a radial field line perpendicular to an axis of the at least one ferromagnetic string, with the spot having one polarity, and the at least one ferromagnetic string poles of the opposite polarity spaced along the at least one ferromagnetic string on opposite sides of the first pole of the radial magnetic field located at the spot; and a magnetic field sensor positioned proximal to the spot along each of the at least one ferromagnetic string that detects motion of the spot and electrically amplifies output of the sensor.

18. The musical instrument of claim 17, wherein:

said apparatus comprises a bar magnet for magnetizing the spot along the at least one ferromagnetic string by bringing one pole end of the bar magnet into contact with the at least one ferromagnetic string and slowly removing the one pole end such that the spot is magnetized to a pole orientation opposite to that of the one pole end, whereby pole orientations opposite to that of the spot are created along the at least one ferromagnetic string both above and below the spot so as to create the magnetic field that approximates a disk shape with radial field lines that decay as 1/R.

19. The musical instrument of claim 18, wherein said sensor is located directly under the at least one ferromagnetic string and responds to vertical components of string motion.

20. The musical instrument of claim 18, wherein said sensor comprises a plurality of sensors that are located at +45 degrees or −45 degrees with respect to a line from a fretboard of the musical instrument to the at least one ferromagnetic string.

21. The musical instrument of claim 17, wherein:

said apparatus comprises an electromagnet for magnetizing the spot along the at least one ferromagnetic string such that the spot is magnetized to a pole orientation opposite to that of one pole of the electromagnet, whereby pole orientations opposite to that of the spot are created along the at least one ferromagnetic string both above and below the spot so as to create the magnetic field that approximates a disk shape and with radial field lines that decay as 1/R.

22. The musical instrument of claim 18, wherein said sensor comprises a plurality of magnetic field sensors that form a quadrature string at least one ferromagnetic motion transducer that includes two unidirectional transducers mounted at right angles proximal to the spot along the string.

23. The musical instrument of claim 18, wherein said sensor comprises magnetic field sensors that are mounted on a rod that is fixed to a butt block of the musical instrument.

24. The musical instrument of claim 18, wherein:

said apparatus comprises a linear magnet arrangement having three poles, in which arrangement a middle pole has a polarity opposite to that of two end poles, for magnetizing the spot along the at least one ferromagnetic string by bringing the three poles simultaneously into contact with the at least one ferromagnetic string and slowly removing the three poles such that the spot is magnetized to a pole orientation opposite to that of the middle pole and pole orientations opposite to that of the spot are created along the at least one ferromagnetic string both above and below the spot so as to create the magnetic field that approximates a disk shape with radial field lines that decay as 1/R.

* * * * *